US006539877B1

(12) United States Patent
Saunders

(10) Patent No.: US 6,539,877 B1
(45) Date of Patent: Apr. 1, 2003

(54) ELEVATED TRANSIT VEHICLE

(76) Inventor: Stanley S. Saunders, 315 Old Ivy, Rd., Atlanta, GA (US) 30342

( * ) Notice: Subject to any disclaimer, the term of this patent is extended or adjusted under 35 U.S.C. 154(b) by 0 days.

(21) Appl. No.: 09/391,984

(22) Filed: Sep. 9, 1999

Related U.S. Application Data

(60) Provisional application No. 60/099,690, filed on Sep. 10, 1998.

(51) Int. Cl.[7] ..... B61J 3/00

(52) U.S. Cl. ..... 104/242; 105/238.1; 180/311

(58) Field of Search ..... 105/238.1, 329.1, 105/27, 29, 122, 243; 410/44; 414/460, 459; 180/311, 89.1; 104/242

(56) References Cited

U.S. PATENT DOCUMENTS 3,197,229 A * 7/1965 Houlton ..... 280/91
3,315,829 A * 4/1967 Cellini ..... 214/392
3,593,859 A * 7/1971 Spannlang ..... 214/1 D
4,058,183 A * 11/1977 Kroger ..... 180/89.1
4,176,609 A * 12/1979 Allen ..... 104/88
4,256,230 A * 3/1981 Clark, Jr. et al. ..... 212/216
4,279,347 A * 7/1981 Appleman ..... 212/147
4,378,072 A * 3/1983 Appleman et al. ..... 212/218
4,599,030 A * 7/1986 Skaalen et al. ..... 414/460
4,702,661 A * 10/1987 Bisiach ..... 414/460

FOREIGN PATENT DOCUMENTS

JP 02282196 A * 11/1990 ..... B66F/9/06

* cited by examiner

*Primary Examiner*—S. Joseph Morano
*Assistant Examiner*—Frantz F. Jules
(74) *Attorney, Agent, or Firm*—Thomas, Kayden, Horstemeyer & Risley

(57) ABSTRACT

An elevated transit vehicle (12) is mounted on vertical wheel supports (16) which operate in curbways (40) along public streets (24). The height of the passenger cab (12) is great enough to permit conventional passenger cars (32) to move beneath the transit vehicle. The curbways block movement of passenger vehicles (32) into the space (46) between the curbways except at traffic intersections where the curbways terminate. The elevated transit vehicle operates across traffic intersections without the aid of the curbways, and other smaller passenger vehicles (32) can enter or exit from between the curbways (40) at these gaps between segments of the curbways. An inter-modal version of the transit vehicle utilizes both the wheel assemblies and a suspended railway (74) which carries the transit vehicle on rail wheels.

30 Claims, 4 Drawing Sheets

ELEVATED TRANSIT VEHICLE

CROSS REFERENCE

Applicant claims the benefit of co-pending provisional patent application Ser. No. 60/099,690 filed in the U.S. Patent And Trademark Office on Sep. 10, 1998.

FIELD OF THE INVENTION

This invention relates in general to a vehicle for transporting people, and more particularly relates to an elevated bus-type vehicle utilizing the space above cars and below bridges.

BACKGROUND OF THE INVENTION

An ever-increasing amount of motor vehicle traffic has brought congestion to city streets. As population figures continue to increase, public transportation becomes more and more of a necessity.

For many years, urban planners have been seeking solutions to traffic problems. Many modem cities are equipped with subway systems, buses and/or elevated train systems. The benefit of using such methods of transportation are to transport a large number of people in one vehicle thus reducing congestion on city streets.

Subway systems typically require elaborate planning by city officials. The cost of such systems are often prohibitive. It may also be necessary to obtain a right-of-way or easement to create the underground passage. Subway stations also require a large amount of land that may be difficult to obtain in an already-congested urban area.

Traditional buses are employed in virtually all cities. Trouble arises in areas of high traffic congestion due to frequent stops made by buses, continuously delaying passenger vehicles.

Some cities use above-ground trains to alleviate public transportation problems. These systems also tend to be very costly and it may be even more difficult to obtain the right-of-way or easement to lay the appropriate tracks. It may be particularly difficult to position train tracks in already congested areas where alleviation of traffic problems is most desired. Accordingly, there is a need in the art for an improved method of transportation in congested urban areas that is cost-effective, does not require an easement or right-of-way and does not add to surface street congestion.

SUMMARY OF THE INVENTION

The present invention is an elevated vehicle capable of traveling above cars on a normal city street. This invention increases the transport capacity and versatility of existing roadways by utilizing the space universally existing between the five foot six inch elevation of most modern automobiles and the fifteen foot clearance which exists on most city streets.

The elevated vehicle is capable of moving in highly congested areas making frequent stops without disturbing the existing traffic. The vehicle is elevated, creating a space underneath through which cars can travel. Passengers are loaded and unloaded by an elevated platform mounted above the existing sidewalks so that pedestrian traffic is likewise not impeded.

Specially cast curbways are placed on the lane dividers of the street defining the pathway for the vehicle. The curbways are elevated and spaced apart so that a car can travel in the lane formed between the two elevated curbways. The curbways define the pathway of the elevated vehicle, which travels above the cars, providing guidance and a smooth-running surface. Although the wheels of the elevated vehicle reach the ground like a normal bus, elongated wheel support members connecting the cabin of the vehicle to the wheels creates space in which cars may travel. The curbways contain gaps so that a car traveling in the lane between the two elevated curbway structures can exit the lane at predetermined locations.

The curbway preferably is pre-cast concrete anchored to the street. The ends of the curbway are tapered so that there is a smooth transition as the elevated vehicle leaves the curbway and engages the street.

Each wheel of the elevated vehicle travels in the path created by the two elevated walls of the curbways surrounding the wheel. Sections of the curbway are fashioned so that they may interlock, creating a smooth transition for the elevated vehicle between curbway sections. The curbways must be made of a material capable of supporting the concentrated weight of the elevated vehicle.

The elevated vehicle has a cabin for carrying passengers much like a conventional bus or train. The floor of the cabin must be at least six feet above the street level. The roof of the vehicle must be less than fifteen feet above the street level to avoid colliding with bridges and other structures. Thus, the interior height of the cabin is approximately nine feet.

Preferably, it is necessary to exclude vehicles over six feet high from the lane defining the pathway for the elevated vehicle. This can be done by providing a clearance bar at a height of six feet at every point where a car may enter such a lane. Cars and other vehicles standing above six feet high are forced to use an alternate lane. Usually the curbways terminate at a street intersection and resume on the opposite side of the intersection.

The elevated vehicle preferably may be powered by any type of existing internal combustion engine. It may be preferable to power the elevated vehicle electrically, using a battery-powered source with opportunity charging units located along the predefined path of the elevated vehicle. It may be beneficial to locate the charging stations at the elevated platforms at which the elevated vehicle will stop to load and unload passengers. The elevated vehicle is equipped with standard braking equipment.

The elevated vehicle preferably may be equipped with a all-wheel steering system as is currently available, generally as described in U.S. Pat. No. 4,286,915. This allows the wheels of the elevated vehicle to follow the curbway around curves and corners. In one embodiment of the present invention, the elevated vehicle is steered by a vehicle operator such that each wheel is maintained inside the curbway. In such an instance where there is no curb, such as at an intersection, the operator steers the vehicle normally until the elevated vehicle engages the next set of curbways. In another embodiment, the wheels of the elevated vehicle may actually engage the curbway. The curbway would thus act as a guide for the elevated vehicle. In such a configuration, the vehicle only needs to be steered in those situations where there is no curbway. It is also possible to provide the elevated vehicle with a Global Positioning System (GPS) system of automatic handling which may eliminate the need for a vehicle operator.

The elevated vehicle may be equipped with numerous video cameras and monitors in order to check vehicle clearance underneath and proper negotiation of intersections. As the elevated vehicle negotiates a turn, it is necessary to determine that there are no cars underneath the elevated vehicle. A camera underneath the vehicle preferably may be used to indicate to the operator that the area underneath the vehicle is clear. A physical barrier may be lowered from the rear of the elevated vehicle so that no car is able to enter the space under the elevated vehicle as the vehicle makes the turn. Once the elevated vehicle has completed the turn and is proceeding in the appropriate path defined by the curbways, the barrier may be retracted and cars may freely travel beneath the elevated vehicle.

The four-wheel steering of the elevated vehicle enables it to approach an elevated platform and come to a stop with a minimal gap between the platform and the vehicle. This facilitates passenger entry and exit of the elevated vehicle.

The wheels of the elevated vehicle may use tires such as that typical of a city bus. It is necessary to provide an extended wheel structure connecting the wheel to the elevated vehicle in order to create the required clearance for cars to pass underneath the elevated vehicle. The wheel is attached to the elevated vehicle using an elongated member or structure similar to the tilting landing gear used by aircraft or similar to telescopic wheel supports utilized by the elevated vehicle of U.S. Pat. No. 4,286,915. The elevated vehicle typically has four wheels, each wheel connected to the elevated vehicle by a similar elongated member that can be used to change the elevation of the vehicle.

In another alternate embodiment of the present invention, an advanced model of the elevated vehicle is capable of operating on public roads with the wheels supports in the retracted position so that the vehicle is lowered to "ground clearance." In this configuration it is capable of operating more like and substituting for a standard bus.

In an alternate embodiment of the present invention, the elevated vehicle is equipped for inter-modal operation. In this embodiment, the elevated vehicle engages a suspended rail above the vehicle. Couplings extending from the top of the elevated vehicle engage the overhead rail. In such a configuration, the wheels of the elevated vehicle are retracted in a manner as described above and the vehicle is powered in the same manner as an overhead-powered trolley. In this configuration, the rail may be raised at street intersections so that the elevated vehicle may move freely through each intersection and be unobstructed by cars and trucks underneath. The wheels can be made to pivot in a manner such that they remain parallel to the sides of the elevated vehicle when they are raised and do not interfere with any cars that may be underneath the elevated vehicle at such time.

DETAILED DESCRIPTION

Figure 1:
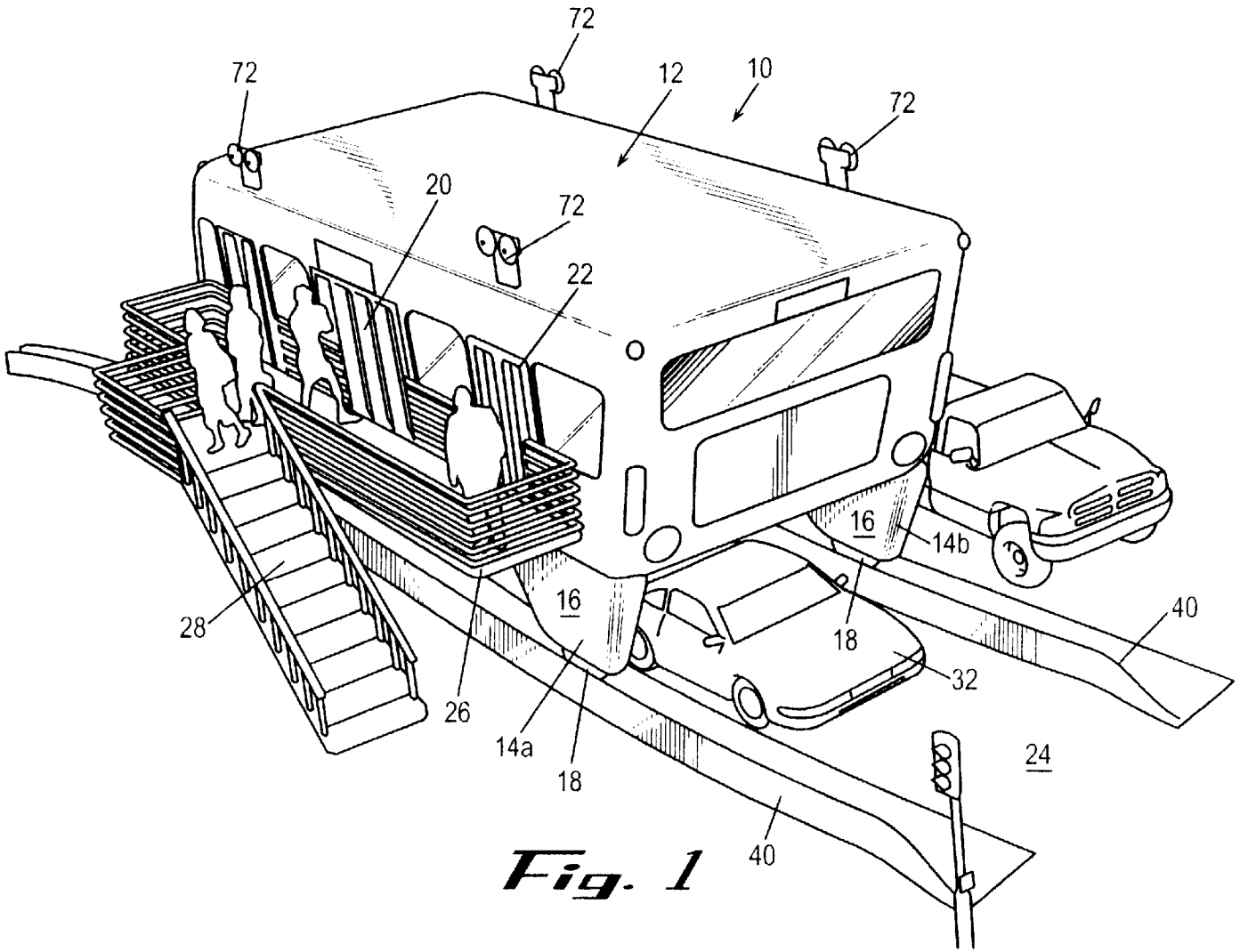
FIG. 1 is a perspective view of the elevated transit vehicle.
Figure 5:
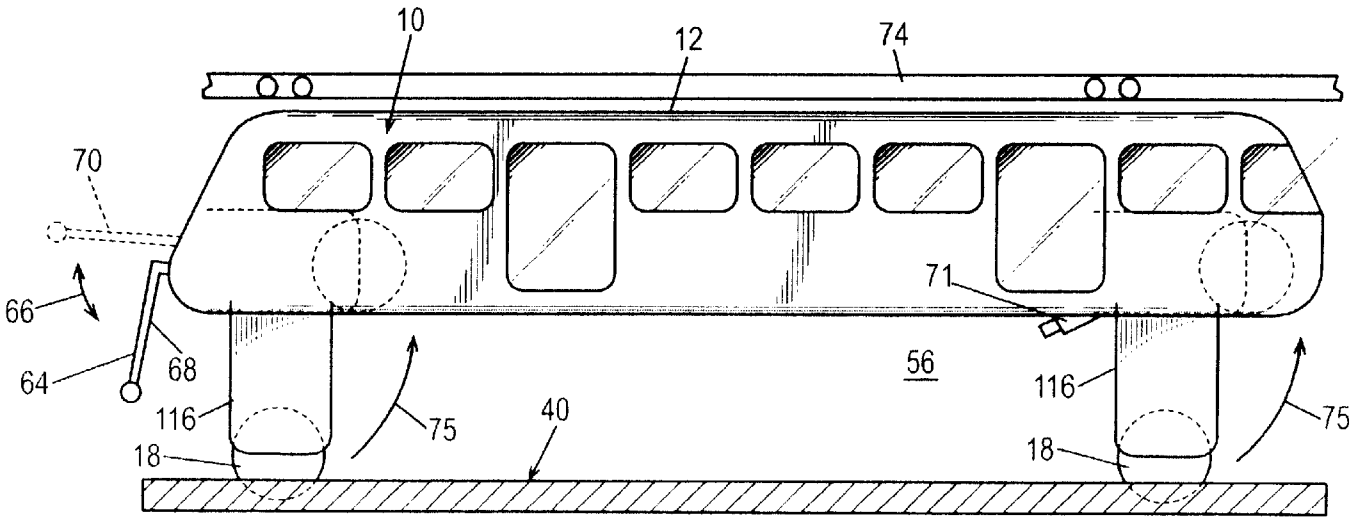
FIG. 5 is a side elevational view illustrating the retractable wheel structures and the elevated rail support for the vehicle.

Referring now in more detail to the drawings, in which like numerals refer to like parts throughout the several views, FIG. 1 illustrates the elevated transit vehicle 10 which can be considered a bus having an elongated passenger cab 12 mounted on wheels 18. Typically, the elevated vehicle will have four wheel assemblies 14*a*, 14*b*, 14*c* and 14*d* which support the passenger cab 12 at the comers of the passenger cab. Each wheel assembly includes a vertical wheel support 16 mounted to the lower portion of the passenger cab 12 on the superstructure of the passenger cab (not shown), and a steerable wheel 18 is mounted at the lower end of the vertical wheel support 16. The wheels 18 are steerable and are driven in a conventional manner, generally as disclosed in U.S. Pat. Nos. 4,286,915 and 4,828,062. Additionally, the wheel assemblies can be movable with respect to the elongated passenger cab 12, as indicated in FIG. 5, whereupon the wheel supports 116 can be tilted upwardly from a vertical latitude to a more horizontal attitude, generally like a conventional aircraft landing gear, generally of the type disclosed in U.S. Pat. Nos. 4,396,170, 4,524,929, and 4,637,574. Also, folding landing gear can be utilized, such as disclosed in U.S. Pat. Nos. 5,022,609 and 5,263,664. Also, the wheels can be powered generally as described in U.S. Pat. No. 5,351,775. As an alternative to tilting the vertical wheel supports 116, the wheel supports can be constantly oriented in a vertical attitude and retracted and distended telescopically, generally as described in U.S. Pat. No. 4,286,915.

As illustrated in FIG. 1, the passenger cab 12 is constructed in a conventional manner in that it includes entrance and exit doors 20 and 22 for the ingress and egress of passengers. Since the vehicle is elevated from the street 24, the passengers will utilize an elevated passenger platform 26 which also functions as a docking station. The passenger platform will have stairs or an escalator or ramp 28 to facilitate the vertical movement of the passengers to the height of the elevated passenger platform 26.

Figure 2:
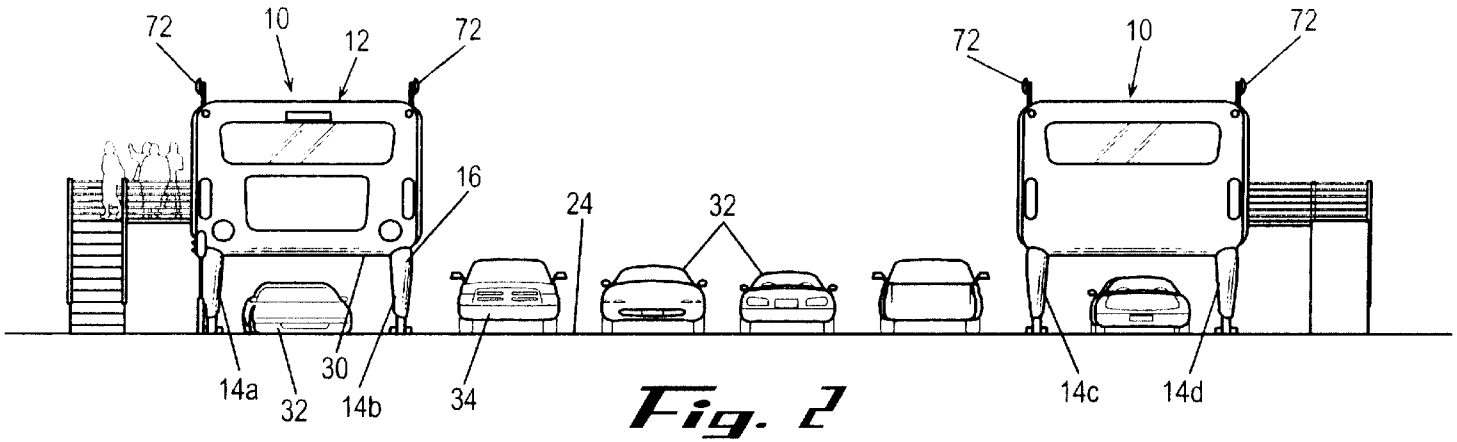
FIG. 2 is an elevational view of two elevated transit vehicles on a public street with other passenger vehicles.

As illustrated in FIG. 2, the vertical wheel supports 16, when in their downward, distended configuration, maintain the bottom surface 30 of the passenger cab 12 elevated above the public street 24 a distance sufficient to permit the vehicle to pass over other passenger vehicles of conventional size. Typically, other passenger vehicles will be approximately 5 feet to 6-½ feet high. For example, the small passenger vehicle 32 may be 5 feet high, whereas a higher sports utility vehicle or pickup truck 34 may be 6-½ feet high. Therefore, the height of the lower surface 30 of the passenger cab 12 is typically to be placed at 78 inches from street level, which is the typical height of a garage door opening of a family residence.

Figure 6:
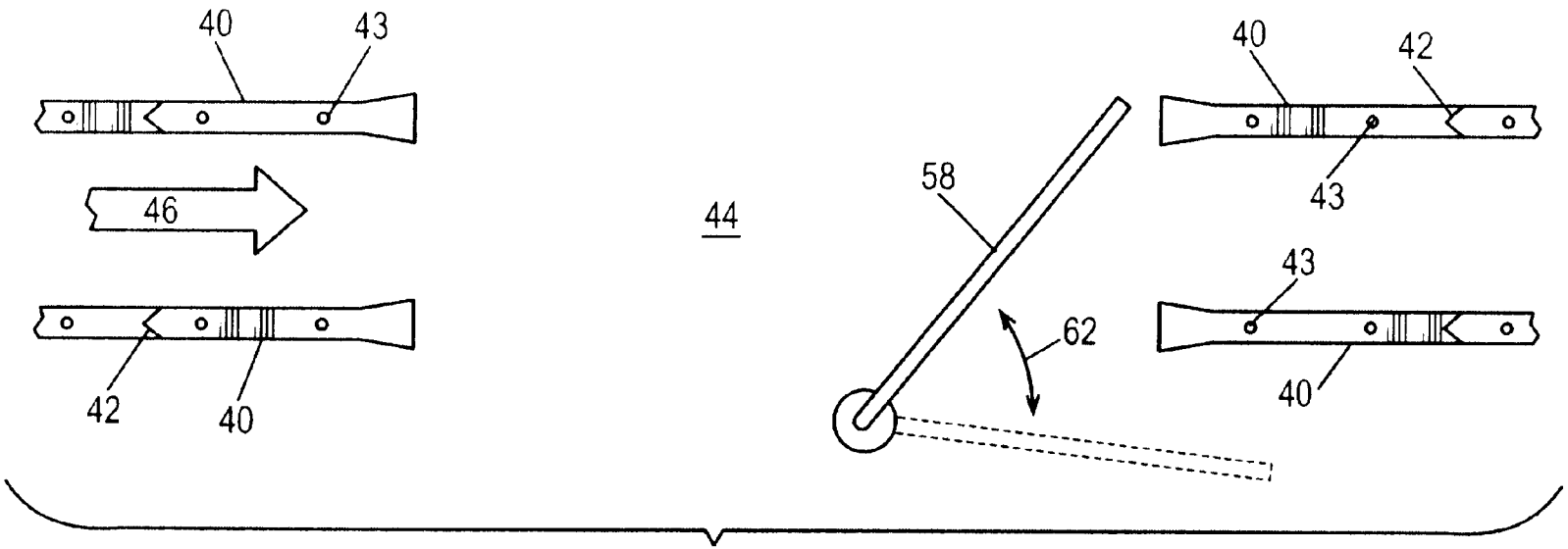
FIG. 6 is a schematic of two adjacent segments of curbways, and a traffic control arm that controls the movement of vehicles into the curbways.

Usually, the wheels 18 of the elevated transit vehicle 10 will operate along curbways or guardways 40 which are placed along the public street 24. The curbways are formed in segments of cast concrete and are placed end-to-end with interlocking ends 42 (FIG. 6) assuring that the curbways will always be in proper alignment. The segments of curbways are placed parallel to each other to form a way 46 for the elevated transit vehicle, generally as illustrated in FIG. 6 and connected to the public street by spikes 43 or other conventional connectors.

The curbways 40 are approximately U-shaped in cross-section, and each includes a base wall 48 and a pair of spaced, parallel sidewalls 50 and 52. The spacing of the sidewalls 50 and 52 is adequate to receive the wheels 18 of the elevated transit vehicle. The height of the sidewalls 50 and 52 is sufficient to guide the wheels 18 of the vehicle when the vehicle is traveling along the curbways.

Figure 3:
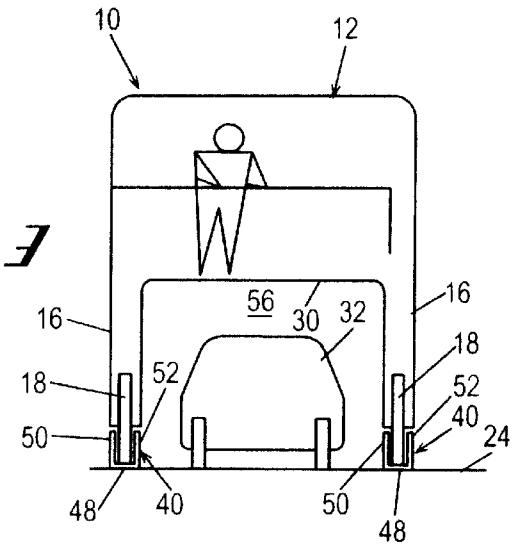
FIG. 3 is a schematic front elevational view of the elevated transit vehicle showing how the vehicle can pass over other smaller passenger vehicles or how the other passenger vehicles pass beneath the vehicle.

The curbways 40 will be placed on or at street level 24, so that the sidewalls 50 and 52 project above the street level and therefore tend to curb or deflect the wheels of other passenger vehicles from entering the way 46 defined between the curbways 40. This eliminates the presence of other passenger vehicles, such as vehicles 32 or 34, from entering the curbways from a lateral direction. However, as illustrated in FIG. 6, vehicles can enter the way 46 between curbways 40 at the gaps 44 between the segments of the curbways. For example, FIGS. 1 and 3 illustrate other passenger vehicles 32 positioned between curbways 40. It will be noted that the vertical wheel supports 16 are positioned far enough apart, preferably more than 9 feet, so as to straddle the passenger vehicles 32, and the elevation of the bottom surface 30 of the passenger cab 12 is high enough to pass over the top of the vehicle 32. Likewise, if the elevated transit vehicle 10 is stationary, a passenger vehicle 32 can pass beneath it without being obstructed.

Figure 4:
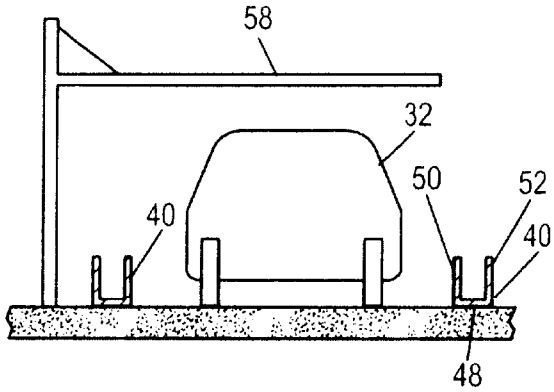
FIG. 4 is a front elevational view of a pair of parallel curbways, another passenger vehicle between the curbways, and a height barrier over the curbways.

There are times when it is desirable from a safety standpoint and an operational standpoint to make sure that there are no other passenger vehicles present in the space 56 beneath the passenger cab 12. In order to control this, a barrier gate 58 can be placed at the entrance 60 of a pair of curbways 40 so as to block oncoming movement of other passenger vehicles. The gate can be opened as indicated by arrow 62 by conventional electronic signal or other gate operation means, so as to admit the elevated transit vehicle to the curbways. As illustrated in FIG. 4, the barrier 58 can be placed at a height above the anticipated height of the passenger vehicle 32, so as to selectively admit the passenger vehicles 32 while barring the admission of taller vehicles, such as industrial trucks.

Likewise, there are times when there will be other passenger vehicles 32 present in or moving along the way 46 between curbways 40 and it is undesirable to have those vehicles present in the space 56 beneath the elevated transit vehicle. This is particularly true when the elevated transit vehicle is moving between segments of curbways 40, through a gap 44 (FIG. 6), where the curbways are not present to control the ingress or egress of other passenger vehicles to the way 46. In order to avoid the presence of passenger vehicles beneath the elevated transit vehicle, a barrier bar 64 (FIG. 5) is mounted to the rear of the passenger cab 12, and is movable as indicated by arrow 66 between a lowered position 68 which blocks the movement of a passenger vehicle from entering the space 56 from behind the transit vehicle, to a raised position 70 where it does not block the movement of passenger vehicles.

Also, a video camera 71 is mounted beneath the passenger cab 12 and projects an image of the space 56 to a monitor (not shown) in the passenger cab to inform the driver of other vehicles beneath the elevated transit vehicle.

As illustrated in FIGS. 1, 2 and 5, rail wheels 72 are mounted on the superstructure (not shown) of the passenger cab 12 and protrude upwardly from the passenger cab for the purpose of engaging suspended railways 74. The rail wheels are positioned at the sides of the passenger cab, fore and aft, so as to balance the cab as it moves along the railways 74. The rail wheels 72 are driven so as to propel the passenger cab along the railways.

As the passenger cab 12 is suspended on and moved along the railways 74, the vertical wheel supports 16 can be retracted so as to disengage from the street 40, if desired, as indicated by the arrows 75 of FIG. 5. Typically, the transit vehicle will be moved on its steerable wheels 18 until its rail wheels engage the railways at an open end of the railways, and when the rail wheels make proper engagement with the railways, the wheel assemblies can be retracted, either by tilting as illustrated in FIG. 5, or by telescopic retraction, as disclosed in U.S. Pat. No. 4,286,915. With this arrangement, the transit vehicle can pass through intersections or otherwise be transported in an elevated situation completely removed from the street 24 and the curbways 40.

When the vehicle 10 is to land on the public street 24, the wheel supports 16 will be moved back to their distended positions as illustrated in FIG. 5 for engagement with the street, and the rail wheels 72 will run off the ends of the suspended railway 74.

The rail wheels 72 are driven on the suspended railways in the same manner as an industrial overhead powered trolley. Typically, the drive system for the elevated transit vehicle is by electric motor, powered by an on-board battery. The battery can be recharged from time to time, typically at one of the docking stations 26.

An advantage of the inter-modal configuration of the elevated vehicle as shown in FIG. 5 is that the suspended railways can be suspended high over street intersections or s other areas where it is desirable not to have the transit vehicle travel at street level. This allows the elevated transit vehicle to travel through the intersections clearing not only the cars but also traffic signals, signs and other conventional obstructions. The elevated vehicle could thus travel through an intersection regardless of the traffic conditions without hazard to or from other passenger vehicles or even taller vehicles underneath.

Although a preferred embodiment of the invention has been disclosed in detail herein, it will be obvious to those skilled in the art that variations and modifications of the disclosed embodiments can be made without departing from the spirit and scope of the invention as set forth in the following claims.

What is claimed is:

1. A method of transporting passengers about public streets comprising:

providing a transit vehicle having an elongated passenger cab supported on wheels and elevated at a height greater than other passenger vehicles;

moving the transit vehicle along its length on the wheels about the public streets between docking stations;

moving the transit vehicle over the other passenger vehicles of a height less than the height of the cab of the transit vehicle;

moving the transit vehicle into juxtaposition with the docking stations;

adjusting the height of the passenger cab to the height of the docking station; and loading the passengers from the docking stations into the passenger cab and unloading the passengers from the passenger cab onto the docking stations.

2. The method of claim 1 wherein the step of moving the transit vehicle about the public streets comprises:

driving the wheels of the passenger cab with a battery powered electric motor; and charging the battery of the electric motor at the docking stations when the transit vehicle is docked at a docking station.

3. The method of claim 1 wherein the step of moving the transit vehicle on its wheels comprises:

guiding the transit vehicle with all of the wheels.

4. The method of claim 1 and further including the step of:

adjusting the height of the passenger cab with respect to the street.

5. The method of claim 1 and further including the step of:

moving the other passenger vehicles beneath the passenger cab of the transit vehicle.

6. The method of claim 1 and further including the step of:

blocking with curbways movement of the other passenger vehicles into the path of the transit vehicle.

7. The method of claim 1 wherein the step of moving the transit vehicle on thee wheels comprises the steps of:

moving the wheels of the vehicle on curbways that are U-shaped in cross section with a weight bearing base wall and opposed side walls; and guiding at least some of the wheels with respect to at least one of the opposed side walls.

8. The method of claim 1 wherein the step of moving the transit vehicle into juxtaposition with the docking station comprises the step of:

adjusting the height of the passenger cab to the height of the docking station.

9. The method of claim 1, wherein the step of moving the transit vehicle about the public streets comprises:

moving the passenger cab of the transit vehicle at a height greater than the height of the other vehicles and lower than the lowest height of a bridge.

10. A method of transporting passengers about public streets comprising:

providing a transit vehicle having an elongated passenger cab supported on wheels and elevated at a height greater than other passenger vehicles;

moving the transit vehicle along its length on the wheels about the public streets between docking stations;

moving the wheels of the vehicle along segments of elongated curbways extending about the public streets and along the streets between the segments of elongated curbways, moving the transit vehicle over the other passenger vehicles of a height less than the height of the cab of the transit vehicle;

moving the transit vehicle into juxtaposition with the docking stations;

loading the passengers from the docking stations into the passenger cab and unloading passengers from the passenger cab onto the docking stations, and blocking the spaces between the segments of the elongated curbways from the entry of other vehicles between the curbways.

11. The method of claim 10, and wherein the step of moving the transit vehicle on elongated curbways about public streets comprises:

moving the transit vehicle along parallel curbways extending along a street to an intersection of streets;

moving the transit vehicle beyond the end of one of the curbways and into the street as the transit vehicle moves across an intersection of streets; and moving the transit vehicle back along other curbways extending along the street beyond the intersection of streets.

12. A method of transporting passengers about public streets comprising:

providing a transit vehicle having an elongated passenger cab supported on wheels and elevated at a height greater than other passenger vehicles;

moving the transit vehicle along its length on the wheels about the public streets between docking stations;

moving the transit vehicle over the other passenger vehicles of a height less than the height of the cab of the transit vehicle;

moving the transit vehicle into juxtaposition with the docking stations;

loading the passengers from the docking stations into the passenger cab and unloading passengers from the passenger cab onto the docking stations, and video viewing the space below the passenger cab to determine the presence and absence of objects beneath the passenger cab.

13. A method of transporting passengers about public streets comprising:

providing a transit vehicle having an elongated passenger cab supported on wheels and elevated at a height greater than other passenger vehicles;

moving the transit vehicle along its length on the wheels about the public streets between docking stations of a height corresponding to the elevated passenger cab;

moving the transit vehicle along a series of segments of curbways longitudinally spaced from one another with gaps formed between the entrances of the segments of the curbways, and operating a gate to selectively block the entrance of the other passenger vehicles and admit entrance of the transit vehicle at the gap between the segments of curbways;

moving the transit vehicle over other the passenger vehicles of a height less than the height of the cab of the transit vehicle;

moving the transit vehicle into juxtaposition with the docking stations; and loading passengers from the docking stations into the passenger cab and unloading passengers from the passenger cab onto the docking stations.

14. An elevated transit system for transporting passengers about public streets, comprising:

a transit vehicle;

said transit vehicle including:

an elongated passenger cab having opposed side walls and front and rear ends, a floor and a roof;

wheel supports having upper and lower ends, with said upper ends of said wheel supports mounted in supporting relationship to said passenger cab at said opposed sides of said passenger cab and spaced longitudinally from each other along the length of said passenger cab and extending downwardly from said passenger cab for supporting said passenger cab from the street below said passenger cab;

wheels rotatably mounted to the lower ends of said wheel supports for engaging the street below said passenger cab;

said wheel supports, wheels and said passenger cab being dimensioned to support said floor of said passenger cab at an elevation above the street below said passenger cab of at least six feet and to form a lateral space of at least eight feet between said wheel supports at said sidewall of said passenger cab for the passage of passenger cars of a height of not more than six feet and a width of not greater than eight feet beneath said passenger cab;

over-height barriers positioned for limiting the height of the passenger cars moving beneath said transit vehicle;

power means carried by said passenger cab and connected in driving relationship with at least some of said wheels for moving said transit vehicle about the street below said vehicle; and steering means carried by said passenger cab and connected to at least some of said wheels for steering at least some of said wheels;

whereby the vehicle can move about the street and passenger cars can be present beneath said passenger cab and between said wheels of the vehicle.

15. The transit vehicle of claim 14, and further comprising:

a series of elongated curbways longitudinally aligned with one another positioned on the street below said elevated transit vehicle for receiving the wheels on one side of said vehicle, each of said curbways including at least one upright sidewall for guiding said wheels of said vehicle and a laterally extending wheel support wall for supporting said wheels;

said wheel support wall being of a breadth greater than the breadth of said wheels of said vehicle;

said curbways including connectors at their ends connecting said curbways end-to-end with their sidewalls aligned and their wheel support walls aligned to form a first way for the wheels of said vehicle.

16. The transit vehicle of claim 15, wherein additional ones of said curbways are longitudinally aligned with one another and positioned parallel to the curbways of said first way on the street below said elevated transit vehicle for forming a second way parallel to said first way for the wheels of said vehicle.

17. The transit vehicle of claim 16, wherein said curbways are U-shaped in cross section.

18. The transit vehicle of claim 15, wherein said at least one upright sidewall of said curbway comprises a pair of spaced parallel sidewalls straddling said wheel support wall and spaced from each other a distance greater than the width of said wheels.

19. The transit vehicle of claim 15, wherein said curbways are formed of precast concrete, and anchoring means anchoring said curbways to the street below said transit vehicle.

20. The transit system of claim 19, and further including a docking station positioned adjacent the curbways for loading and unloading passengers of the vehicle.

21. The transit vehicle of claim 14, wherein said steering means of said transit vehicle is connected to all of said wheels for steering all of said wheels.

22. The transit vehicle of claim 14, wherein said power means comprises an electric motor and a rechargeable battery for operating said motor.

23. The transit system of claim 22, and further including a docking station with a battery recharger adapted for recharging the battery of said transit vehicle.

24. The transit system of claim 14, and further including at least one camera supported by said transit vehicle and aimed at the space beneath said passenger cab for revealing any objects beneath said passenger cab.

25. The transit system of claim 14, and further including:

parallel curbways positioned on the street below said transit vehicle and extending above the surface of the street for retarding the entry of other passenger vehicles between the curbways;

said curbways having gaps formed along their lengths for the ingress and egress of passenger cars between said curbways; and gates positioned at the gaps of said curbways for regulating the entry of vehicles between the curbways.

26. The transit system of claim 25 wherein said over height barriers are positioned at gaps in said curbways for limiting the height of the passenger cars moving between said-curbways.

27. The transit system of claim 14, and further including:

elevator means for moving said wheel supports vertically with respect to said passenger cab for raising and lowering said passenger cab with respect to the street.

28. A method of transporting passengers about public streets comprising:

providing a transit vehicle having an elongated passenger cab supported on vertically adjustable wheels;

moving the transit vehicle along its length on the wheels about the public streets between docking stations;

elevating the passenger cab of the transit vehicle to a height greater than the height of other passenger vehicles on the street;

moving the transit vehicle and the other passenger vehicles on the street with respect to each other so that the cab of the transit vehicle and the other vehicles pass each other in vertically displaced relationship;

moving the transit vehicle into juxtaposition with the docking stations; and loading passengers from the docking stations into the passenger cab and unloading passengers from the passenger cab onto the docking stations.

29. The method of claim 28 and further including moving the wheels of the transit vehicle along curbways.

30. The method of claim 28 and further including the step of adjusting the height of the passenger cab to match the height of a docking station.

* * * * *